United States Patent [19]

Thornton

[11] 4,231,572

[45] Nov. 4, 1980

[54] TENNIS BALL TARGET

[76] Inventor: William S. Thornton, 204 Ella St., Lafayette, La. 70506

[21] Appl. No.: 947,074

[22] Filed: Sep. 29, 1978

[51] Int. Cl.[3] ..... A63B 61/00

[52] U.S. Cl. ..... 273/29 A; 273/392; 273/402

[58] Field of Search ..... 273/29 A, 30, 102 R, 273/102 S, 102.1 R, 102.1 B, 102.1 C, 102.1 E, 127 R, 127 B, 127 D, 105 R, 105.1, 105.2, 105.3, 105.4, 105.5, 105.6, 85 R, 95 H, 392, 402; 46/155

[56] References Cited

U.S. PATENT DOCUMENTS

| | | | |
|---|---|---|---|
| 755,936 | 3/1904 | Rican | 273/30 |
| 2,051,476 | 8/1936 | Grant | 273/30 |
| 2,819,903 | 1/1958 | Saunders | 273/105 R |
| 3,464,695 | 9/1969 | Chock | 273/30 |
| 3,993,306 | 11/1976 | Scott | 273/29 A |

FOREIGN PATENT DOCUMENTS

| | | | |
|---|---|---|---|
| 2516 | of 1902 | United Kingdom | 273/30 |
| 176724 | 3/1922 | United Kingdom | 273/85 R |

*Primary Examiner*—Richard C. Pinkham
*Assistant Examiner*—T. Brown
*Attorney, Agent, or Firm*—Blair, Brown & Kreten

[57] ABSTRACT

A target for practicing the game of tennis which includes a frame having an opening through which a tennis ball may be driven by a player, the frame being adapted to be detachably mounted in an upright operative position on an installed tennis net so as to extend upwardly from the upper edge of the net, the frame being attached to the upper ends of a pair of downwardly depending, laterally spaced posts which are arranged to be interwoven within the meshes of the net with a hook being also provided on the upper ends of the posts for overlying hooking engagement with the upper edge of the net together with a spring between the upper end of each post and the frame for yieldingly urging the frame into the upright position so that when struck by a tennis ball, the force of the ball is absorbed by pivotal movement of the frame against the urging force of the springs.

6 Claims, 4 Drawing Figures

TENNIS BALL TARGET

BACKGROUND OF THE INVENTION

Many practice devices for tennis have been proposed in the past most of which are usually of special construction to simulate the actual playing conditions provided by a tennis court. Obviously, while each device has some merit, they cannot be used to develop the high level of skill which is required under competitive playing conditions today. Furthermore, they are complicated in construction, require special setup procedures and are nothing more than a high cost assessory for which a space must be provided.

It has been proposed to provide a target which may be incorporated with a regulation tennis net installation on a playing court such is shown in U.S. Pat. No. 3,993,306. However, tennis target of this patented structure is difficult to install since it is adapted to be clamped to the tennis net support posts and is of a complex construction not warranted by its intended purpose. Such previous efforts have apparently not used the net itself as a target support structure probably due to a concern for the inevitable sag such a net supported structure would produce.

OBJECTS AND SUMMARY OF THE INVENTION

Accordingly, a primary object of this invention is to provide a new and novel tennis ball target for practicing the game of tennis which may be simply and easily attached to and detached from an existing tennis net installation which does not produce any sag in the net and which may be easily mounted in any transverse position on the net.

Another object of this invention is to provide a new and novel net supported tennis ball target which is extremely simple and lightweight in construction, which may be provided in a variety of sizes at low cost so as to permit utilization by players of various degrees of skill and which is adapted to absorb the force of tennis balls by which it is struck so as to be capable of prolonged use without breakdown.

The objects of the invention and other related objects are accomplished by the provision of a frame of rectangular shape having an opening defining a target for the passage of a tennis ball driven by a tennis player. The frame is adapted to be mounted along its lower edge portion to the upper ends of a pair of downwardly extending laterally spaced-apart parallel posts which are interwoven through the meshes in the tennis net to position the frame in an upright, operative position adjacent the upper edge of the net. The upper ends of the posts are also provided with hooked portions which engage the upper edge of the net when the posts are interwoven into the net meshes. The means for mounting the frame to the upper ends of the posts includes a spring on each upper end of the posts which yieldingly urge the frame into the upright, operative position so that the frame absorbs the force of any ball by which it is struck by yielding pivotal movement against the urging force of the springs.

Other objects and advantages of the invention will become apparent from the following description taken in connection with the accompanying drawings.

DESCRIPTION OF THE PREFERRED EMBODIMENT

Figure 1:
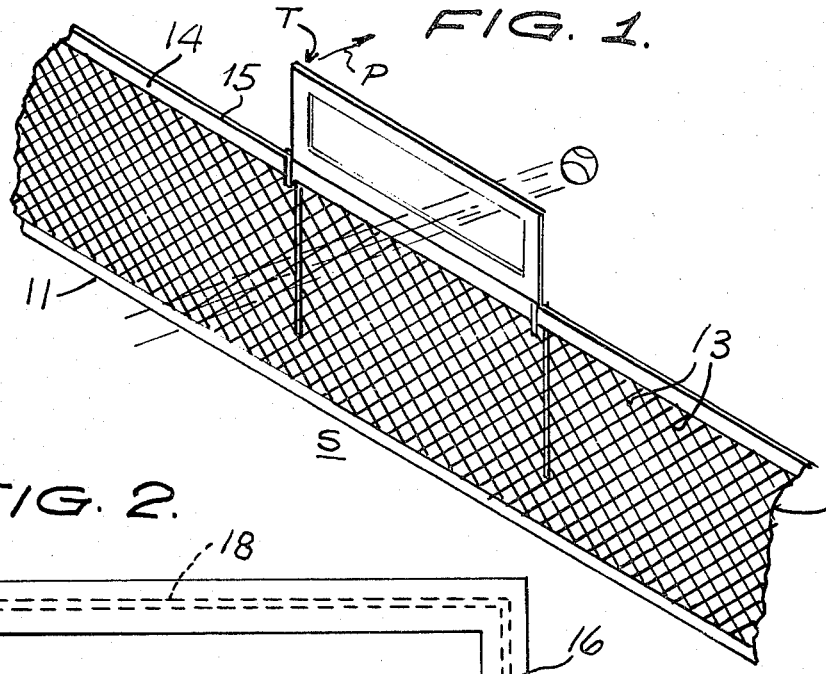
FIG. 1 is a perspective view of the tennis ball target of the invention in an operative position on a tennis net.

Referring now to the drawings and to FIG. 1 in particular there is shown a tennis ball target constructed in accordance with the invention and designated generally by the letter T. The target T is adapted to be detachably mounted on a tennis net 11 of conventional construction shown in the installed position on a playing surface such as a tennis court S or the like. The tennis net 11 shown in FIG. 1 supported at the ends by upstanding posts or the like (not shown) includes suitably woven cords 12 which define meshes 13 and the upper edge of the net 11 is provided with a tape 14 in the conventional manner.

Figure 2:
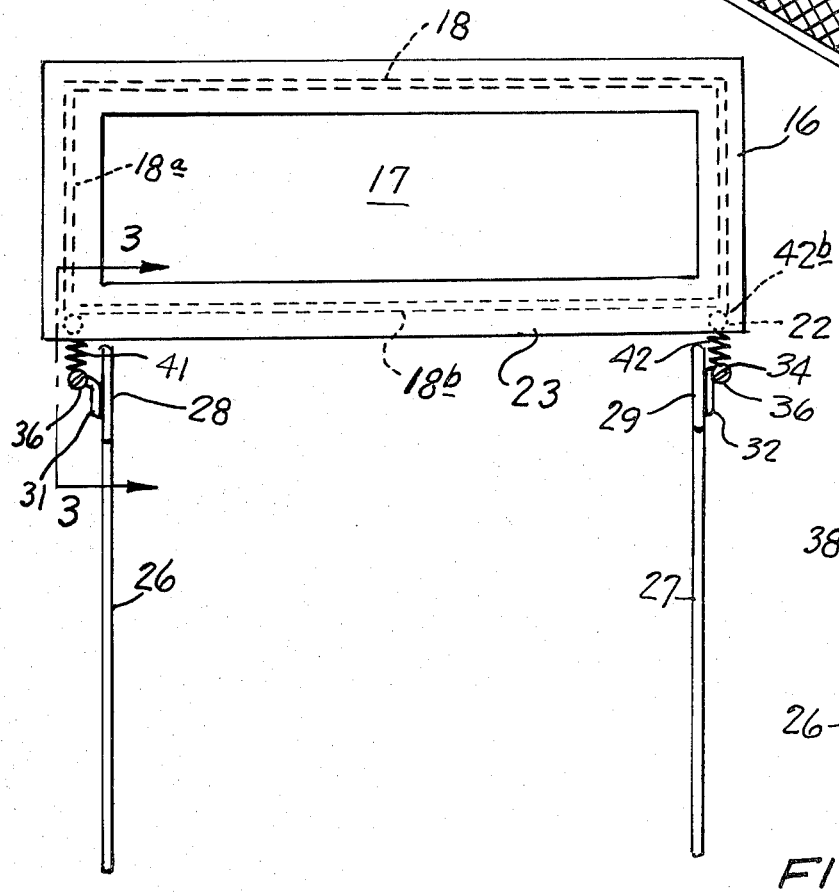
FIG. 2 is a front elevation view of the tennis ball target of FIG. 1.
Figure 3:
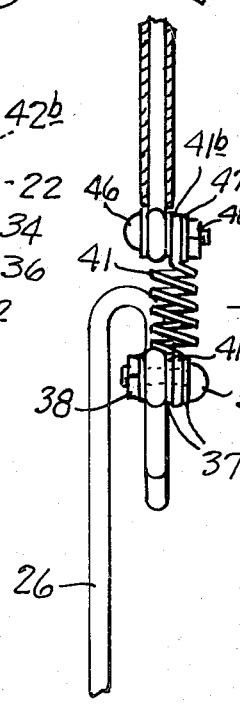
FIG. 3 is an enlarged sectional view taken substantially along line 3—3 of FIG. 2 looking in the direction of the arrows.

The tennis ball target T includes a frame 16 preferably of rectangular shape having an opening 17 defining a target area for the passage of a tennis ball B driven by a tennis player. The frame 16 is preferably formed of a wire rod 18 of steel which may be approximately $\frac{1}{8}$ of an inch in diameter and preferably includes a U-shaped portion 18*a* and a horizontally extending bottom portion 18*b* having bent ends suitably secured by welding or the like to the free ends of the frame portion 18*a* as shown in FIG. 2. For a purpose to be described hereinafter, the free ends of the frame portion 18*a* are provided with eyes 21,22 at each of the bottom corners of the frame 18. In the preferred embodiment a marker 23 of a selected color is suitably secured by an adhesive or the like along the marginal portions of the frame 18 to provide for easy visual identification of the target area 17 on the part of a player. Preferably, the marker 23 is a relatively narrow strip of rigid plastic material having a selected color which is suitably secured to the frame 18 by means of an adhesive or the like.

Figure 4:
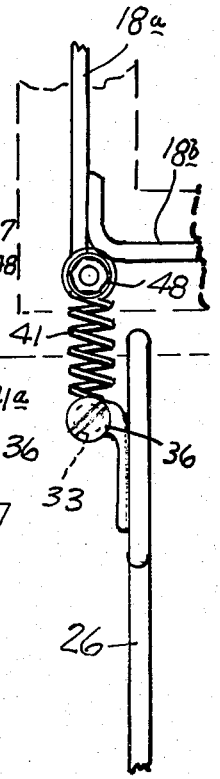
FIG. 4 is a front view of the portion of the invention shown in FIG. 3.

The tennis ball target T includes support means for detachably mounting the frame 16 on the tennis net 11 with the frame 16 in an upright operative position extending above the upper edge of the net defined by the tape 14 in substantially coplanar relationship with the net to present the target area opening 17 to a player. More specifically, the support means comprises a pair of downwardly depending posts 26, 27 arranged in laterally spaced-apart parallel relationship and preferably formed of a rod or the like. The posts 26, 27 are disposed adjacent each side of the frame 16 and are adapted to be interwoven or threaded within the meshes 13 of the net 11 in vertically extending positions as shown in FIG. 1. Means are provided on the upper ends of the posts 26, 27 for engaging the upper edge 15 of the net 11 which include a hook portion 28, 29. Thus, when the posts 26, 27 are interwoven with the net meshes 13 the hooks 28, 29 interengage with the net tape 14 in overlying relationship limiting the downward movement of the posts 26, 27. Means are also provided on the upper ends of the posts 26, 27 for mounting the frame 16 on the posts. More specifically, rod sections 31, 32 suitably secured by welding or the like to each of the hook portions 28,29 respectively extend laterally upward from the hook portions as shown best in FIG. 4. The rod sections 31,32 each terminate at their upper ends in an eye 33, 34 respectively for accommodating a mounting bolt which together with washers 37 and a nut 38 are adapted to attach the lower ends 41*a*, 42*a* of coil springs 41,42 to the eyes 33,34 respectively, for mounting the frame 16 on the upper ends of the posts 26,27.

The upper ends of the springs 41, 42 are provided with eyes 41*b*,42*b* respectively arranged to be mounted on the eyes 21,22 of the frame 16 by a bolt 46, a washer 47 and nut 48. Thus, the springs 41, 42 connected at opposite ends to the posts 26, 27 and to the frame 16 yieldingly position the frame 16 in an upright position with respect to the upper ends of the posts 26, 27.

When the target T is to be installed using the frame 16 with the posts 26, 27 mounted thereon as explained above, the lower ends of the posts 26, 27 are positioned adjacent the net tape 14 and moved downwardly in and out of interwoven engagement with the meshes 13 of the net 11 in a selected transverse position on the net until the hook portions 28, 29 of the posts engage the tape 14 on the net 11 so that the frame 16 is positioned in an upright operative position on the upper edge 15 of the net. It should be understood that the frame 16 is securely positioned in the operative position of FIG. 1 on the net 11 by the frictional engagement between the posts 26,27 and the cords of the net 11 and the hooks 28,29 additionally providing a detachable link between the net 11 and the posts. As springs 41,42 yieldingly urge the frame 16 into the upright position of FIG. 1, when the ball B strikes the frame 16 rather than going through the opening 17 as intended the force of the ball striking the frame 16 is absorbed by a pivotal movement of the frame 16 in the direction of the arrow P in FIG. 1 against the urging force of the springs. Frame 16 subsequently returns to the upright position to be ready to serve as a target for the next ball driven by the player.

Having thus described the preferred embodiment of the invention it should be understood that numerous structural modifications and adaptations may be resorted to without departing from the spirit of the invention.

What is claimed is:

1. A tennis ball target for a tennis net arranged in an installed playing position comprising, in combination, a target frame having an opening defining a target area for the passage of a tennis ball driven by a tennis player, support means for detachably mounting said frame on the tennis net in an upright, operative position with said frame extending above the upper edge of said net substantially in coplanar relationship therewith to present said opening to a player, said support means comprises a pair of downwardly depending posts arranged in laterally, spaced-apart parallel relationship, means on the upper ends of said posts for engaging the upper edge of the tennis net, means on the upper ends of said posts for mounting said frame on said posts, said posts being adapted to be interwoven with the meshes of the net in vertically extending positions with said net engaging means in supporting engagement with the upper edge of the net to detachably support said frame in said operative position, said means for mounting said frame on said posts include a spring on each of said posts for yieldingly urging said frame into said operative position whereby said frame is adapted to move yieldingly from said operative position when struck by a driven tennis ball and, said means for engaging the upper edge of the tennis net include a hook portion on the upper end of each of said posts for hooking engagement with the net upper edge.

2. A tennis ball target in accordance with claim 1 wherein said support means is adapted to be slidably interwoven with the meshes of the tennis net.

3. A tennis ball target in accordance with claim 1 including a marker of a selected color extending along the marginal portions of said frame for visual identification of said frame opening by a player.

4. A tennis ball target in accordance with claim 1 wherein said means for mounting said frame on said posts include an eye on the upper end of each of said posts, a pair of eyes on the lower edge of said frame arranged in laterally spaced relationship, bolt means on each of said posts for connecting the eye on each of said posts with one of said eyes on said frame and wherein said spring on each of said posts is operatively connected to said bolt means to yieldingly urge said frame into said operative position.

5. A tennis ball target in accordance with claim 4 wherein said frame comprises a rod member formed into a rectangular configuration to define said a central opening.

6. A tennis ball structure in accordance with claim 5 including a marking member of strip material having a selected color secured to said rod member, said marking member extending along the marginal portions of said frame for visual identification of said frame opening by a player.

* * * * *